US009714551B2

(12) United States Patent
Okura et al.

(10) Patent No.: US 9,714,551 B2
(45) Date of Patent: Jul. 25, 2017

(54) PLUG FOR WELL DRILLING PROCESS PROVIDED WITH MANDREL FORMED FROM DEGRADABLE MATERIAL

(71) Applicant: Kureha Corporation, Tokyo (JP)

(72) Inventors: Masayuki Okura, Tokyo (JP); Takeo Takahashi, Tokyo (JP)

(73) Assignee: KUREHA CORPORATION, Tokyo (JP)

( * ) Notice: Subject to any disclaimer, the term of this patent is extended or adjusted under 35 U.S.C. 154(b) by 0 days.

(21) Appl. No.: 14/892,045

(22) PCT Filed: May 29, 2014

(86) PCT No.: PCT/JP2014/064315
§ 371 (c)(1),
(2) Date: Nov. 18, 2015

(87) PCT Pub. No.: WO2014/192885
PCT Pub. Date: Dec. 4, 2014

(65) Prior Publication Data

US 2016/0108695 A1 Apr. 21, 2016

(30) Foreign Application Priority Data

May 31, 2013 (JP) ..... 2013-115541
Oct. 23, 2013 (JP) ..... 2013-220222
May 27, 2014 (JP) ..... 2014-109013

(51) Int. Cl.
*E21B 33/12* (2006.01)
*E21B 33/129* (2006.01)

(52) U.S. Cl.
CPC ..... *E21B 33/12* (2013.01); *E21B 33/1208* (2013.01); *E21B 33/1291* (2013.01)

(58) Field of Classification Search
CPC ..... E21B 33/12; E21B 33/1208; E21B 33/128
See application file for complete search history.

(56) References Cited

U.S. PATENT DOCUMENTS 7,353,879 B2 4/2008 Todd et al.
9,267,351 B2 * 2/2016 Okura ..... E21B 33/12
2005/0205266 A1 9/2005 Todd et al.
2006/0113077 A1 6/2006 Willberg et al.
2008/0102119 A1 5/2008 Grovender et al.
2008/0200352 A1 8/2008 Willberg et al.
(Continued)

FOREIGN PATENT DOCUMENTS

CN 2261507 Y 9/1997
CN 101153102 A 4/2008
(Continued)

OTHER PUBLICATIONS

English translation of International Preliminary Report on Patentability and Written Opinion mailed Dec. 10, 2015, in PCT International Application No. PCT/JP2014/064315.
(Continued)

*Primary Examiner* — Matthew R Buck
*Assistant Examiner* — Aaron Lembo
(74) *Attorney, Agent, or Firm* — Birch, Stewart, Kolasch & Birch, LLP

(57) ABSTRACT

A plug for well drilling process comprising: (a) a mandrel formed from a degradable material; (b) a pair of rings placed on an outer peripheral surface existing in the orthogonal to an axial direction of the mandrel, at least one of the rings being formed from a degradable material; and (c) at least one diameter-expandable circular rubber member placed at a position between the pair of rings on the outer peripheral surface existing in the orthogonal to the axial direction of the mandrel; the percentage of mass loss in the degradable material after immersion for 72 hours in water at a temperature of 150° C. preferably being from 5 to 100%; and a well drilling method comprising the step of plugging well hole using the plug for well drilling process, wherein part or all of the plug for well drilling process degrades after the plugging.

31 Claims, 1 Drawing Sheet

(56) References Cited

U.S. PATENT DOCUMENTS

| | | | | |
|---|---|---|---|---|
| 2008/0202764 | A1 | 8/2008 | Clayton et al. | |
| 2008/0289823 | A1 | 11/2008 | Willberg et al. | |
| 2010/0101803 | A1 | 4/2010 | Clayton et al. | |
| 2010/0139930 | A1* | 6/2010 | Patel | E21B 33/1277 166/387 |
| 2011/0067889 | A1 | 3/2011 | Marya et al. | |
| 2011/0277989 | A1 | 11/2011 | Frazier | |
| 2012/0031626 | A1 | 2/2012 | Clayton et al. | |
| 2015/0126414 | A1* | 5/2015 | Abe | C09K 8/12 507/117 |
| 2015/0354311 | A1* | 12/2015 | Okura | B29C 47/0004 175/57 |
| 2016/0108696 | A1* | 4/2016 | Okura | E21B 33/12 166/277 |

FOREIGN PATENT DOCUMENTS

| | | | |
|---|---|---|---|
| CN | 101351523 | A | 1/2009 |
| JP | H04179792 | A | 6/1992 |
| JP | 2003-310474 | A | 11/2003 |
| JP | 2003533619 | A | 11/2003 |
| JP | 2011256221 | A | 12/2011 |
| WO | WO0188333 | A1 | 11/2001 |

OTHER PUBLICATIONS

International Search Report of PCT/JP2014/064315 dated Sep. 2, 2014.

Canadian Office Action, dated Dec. 21, 2016, for Canadian Application No. 2,912,833.

Chinese Office Action and Chinese Search Report, dated Dec. 22, 2016, for Chinese Application No. 201480025331.9, with English translations.

Extended European Search Report, dated Jan. 3, 2017, for European Application No. 14803796.3.

Mingbo et al., "Handbook of Polymers," (vol. 2), Chapter 6 Medical Polymers, Chemical Industry Press, Jun. 2009, pp. 673-674 (Total 11 pages), with an English translation.

* cited by examiner

PLUG FOR WELL DRILLING PROCESS PROVIDED WITH MANDREL FORMED FROM DEGRADABLE MATERIAL

TECHNICAL FIELD

The present invention relates to a plug for well drilling process used in well drilling to produce hydrocarbon resources such as petroleum or natural gas.

BACKGROUND ART

Hydrocarbon resources such as petroleum or natural gas have been mined and produced through wells having a porous and permeable subterranean formation (wells or gas wells; also collectively called wells). Well depths have progressively increased in step with increases in energy consumption. There are records of drilling to depths exceeding 9,000 m around the world, and there are wells over 6,000 m deep in Japan. In wells with ongoing mining, in order to continuously mine hydrocarbon resources efficiently from a subterranean formation whose permeability has diminished over time or a subterranean formation which originally has insufficient permeability, the productive layer is stimulated, and acid treatment or crushing methods are known as stimulation methods (Patent Document 1). Acid treatment is a method of increasing the permeability of the productive layer by infusing a mixture of a strong acid such as hydrochloric acid or hydrogen fluoride into the productive layer and dissolving reactive components of the bedrock (carbonates, clay minerals, silicates, or the like), but various problems associated with the use of strong acids have been indicated, and increases in cost, various countermeasures, have also been indicated. Therefore, attention has been focused on a method of forming fractures in the productive layer by utilizing fluid pressure (also called a "fracturing method" or a "hydraulic fracturing method").

Hydraulic fracturing is a method of generating fractures in the productive layer by means of fluid pressure such as water pressure (also simply called "water pressure" hereafter) and is typically a productive layer stimulation method of well drilling a vertical hole, bending the vertical hole, well drilling a horizontal hole in the stratum several thousand meters underground, feeding a fracturing fluid into the well holes (referring to holes provided to form wells; also called "downholes") under high pressure, producing fractures in the productive layer at a high depth underground (layer for producing hydrocarbon resources such as petroleum or natural gas) with water pressure, and extracting the hydrocarbon resources through the fractures. The efficacy of hydraulic fracturing has also been the focus of attention in the development of non-conventional resources such as shale oil (oil matured in shale) or shale gas.

Fractures formed by fluid pressure such as water pressure is immediately closed by formation pressure once the water pressure is eliminated. In order to prevent the closure of fractures, a proppant is added to the fracturing fluid (that is, a well treatment fluid used for fracturing) and fed into the well hole so as to place the proppant in the fractures. An inorganic or organic material is used as the proppant contained in the fracturing fluid, but silica, alumina, or other inorganic particles are conventionally used since the closure of fractures can be prevented in high-temperature, high-pressure environments deep underground over as long a period as possible, and grains of sand—for example, 20/40 mesh sand or the like—are widely used.

Various types of water-based, oil-based, and emulsion-based well treatment fluid are used as the fracturing fluid. The well treatment fluid must have a functional capable of carrying the proppant to a location where fractures are to be produced in the well hole, so the well treatment fluid ordinarily must have a prescribed viscosity as well as good proppant dispersibility, and there is a demand for the ease of after-treatment and a small environmental burden. In addition, the fracturing fluid may also contain a channelant for the purpose of forming channels through which shale oil, shale gas, or the like can pass between the proppants. Therefore, various additives such as channelants, gelling agents, scale inhibitors, acids for dissolving rock or the like, and friction reducers are used in the well treatment fluid in addition to proppants.

In order to generate fractures in productive layer deep underground (the layer for producing hydrocarbon resources including petroleum such as shale oil or natural gas such as shale gas) with water pressure using a fracturing fluid, the following method is ordinarily employed. Specifically, for a well hole (downhole) bored into the stratum several thousand meters underground, prescribed sections are partially isolated while plugging sequentially from the end of the well hole, and fracturing is performed to generate fractures in the productive layer by infusing a fracturing fluid at high pressure into the isolated sections. Next, a prescribed section (ordinarily in front of the preceding section—that is, a section on the surface side) is isolated and fractured. This process is performed repeatedly thereafter until the required plugging and fracturing are complete.

The stimulation of the productive layer by means of secondary fracturing is performed not only for the drilling of a new well, but also for a desired section of a well hole that has already been formed. In this case as well, an operation of isolating the well hole and performing fracturing may be similarly performed. In addition, in order to finish the well, the well hole may be isolated so as to isolate the fluid from the lower part, and the isolation may be removed after the upper part is finished.

There are various known methods of isolating a well hole, performing fracturing, or the like. For example, plugs capable of isolating or fixing a well hole (also called "frac plugs", "bridge plugs", "packers", or the like) are disclosed in Patent Documents 2 and 3.

A downhole plug for well drilling (also simply called a "plug" hereafter) is disclosed in Patent Document 2. Specifically, Patent Document 2 discloses a plug provided with a mandrel (main body) having a hollow part in the axial direction and a ring or annular member, a first conical member and slip, a malleable element formed from an elastomer, a rubber, or the like, a second conical member and slip, and an anti-rotation feature along the axial direction on the outer peripheral surface existing in the orthogonal to the axial direction of the mandrel. The sealing of a well hole with this downhole plug for well drilling is as follows. Specifically, by moving the mandrel in the axial direction thereof, the slips make contact with the inclined surface of the conical member and advance along the conical members as the gap between the ring or annular member and the anti-rotation feature is reduced. As a result, the slips expand radially outward and make contact with the inside wall of the well hole so as to be fixed to the well hole, and the malleable element expands in diameter, deforms, and makes contact with the inside wall of the well hole so as to seal the well hole. The mandrel has a hollow part in the axial direction, and the well hole can be sealed by setting a ball or the like in the hollow part. A wide range of materials such as metal materials (aluminum, steel, stainless steel, and the like) fibers, wood, composite materials, and plastics are given as examples of materials for forming the plug. It is described that the material is preferably a composite material containing a reinforcing material such as carbon fibers and particularly a polymer composite material such as an epoxy resin or phenol resin, and that the mandrel is formed from aluminum or a composite material. On the other hand, it is described that in addition to the materials described above, materials which decompose due to temperature, pressure, pH (acid, base), or the like can be used as the ball or the like.

Downhole plugs for well drilling are successively placed in the well until the well is complete, but they may need to be removed at the stage when the production of petroleum such as shale oil or natural gas such as shale gas (also collectively called "petroleum or natural gas" or "petroleum and/or natural gas" hereafter) or the like is begun. Plugs are not ordinarily designed to be retrievable by removing the isolation after use and are removed as a result of being destroyed or fragmented by crushing, well drilling, or another method, but crushing, well drilling, or the like required a large amount of time and money. In addition, there are also plugs specially designed so as to be retrievable after use (retrievable plugs), but since the plugs are placed deep underground, a large amount of time and money were required to recover all of the plugs.

Patent Document 3 discloses a disposable downhole tool (meaning a downhole tool or the like) containing a biodegradable material which degrades when exposed to the environment inside a well, and a member thereof, and degradable polymers including aliphatic polyesters such as polylactic acid are disclosed as biodegradable materials. Further, Patent Document 3 discloses a combination of a tubular body element having a flow bore in the axial direction and a combination of a packer element assembly comprising an upper sealing element, a central sealing element, and a lower sealing element and a slip and a mechanical slip body along the axial direction on the outer peripheral surface existing in the orthogonal to the axial direction of the tubular body element. In addition, it is disclosed that the flow of a fluid is permitted in only one direction by setting a ball in the flow bore of the tubular body element. However, there is no disclosure in Patent Document 3 as to whether a material containing a biodegradable material is used for either the downhole tool or the member thereof.

In response to increasing demands for the procurement of energy resources, environmental protection, and the like, and as the mining of non-conventional resources expands, in particular, there has been a demand for a plug for well drilling process which enables the reliable isolating and fracturing of a well hole and is capable of reducing the cost of well drilling and shortening the process by facilitating the removal of the plug for well drilling process and the procurement of a flow path.

CITATION LIST

Patent Literature

Patent Document 1: Japanese Unexamined Patent Application Publication (Translation of PCT Application) No. 2003-533619A (corresponding to WO/01/088333)

Patent Document 2: US Patent Application Publication No. 2011/0277989 A1 specification Patent Document 3: US Patent Application Publication No. 2005/0205266 A1 specification

SUMMARY OF INVENTION

Technical Problem

A problem of the present invention is to provide a plug for well drilling process which enables the reliable isolating and fracturing of a well hole under increasingly rigorous mining conditions such as higher depths and is capable of reducing the cost of well drilling and shortening the process by facilitating the removal of the plug for well drilling process and the procurement of a flow path. Another problem of the present invention is to provide a well drilling method using the plug for well drilling process.

Solution to Problem

As a result of conducting dedicated research in order to solve the problems described above, the present inventors discovered that the problems can be solved by placing a ring and a diameter-expandable circular rubber member or the like on the outer peripheral surface of a mandrel and using specific materials for these components, and the present inventors thereby completed the present invention.

That is, a first aspect of the present invention provides a plug for well drilling process comprising: (a) a mandrel formed from a degradable material;

(b) a pair of rings placed on an outer peripheral surface existing in the orthogonal to an axial direction of the mandrel, at least one of the rings being formed from a degradable material; and (c) at least one diameter-expandable circular rubber member placed at a position between the pair of rings on the outer peripheral surface existing in the orthogonal to the axial direction of the mandrel.

In addition, the plug for well drilling process of (2) to (30) below are provided as specific embodiments of the invention according to the first aspect of the present invention.

(2) The plug for well drilling process according to (1), wherein the mandrel is formed from a degradable material having a tensile strength of at least 50 MPa at a temperature of 60° C.

(3) The plug for well drilling process according to (1) or (2), wherein the mandrel is formed from a degradable material having a shearing stress of at least 30 MPa at a temperature of 66° C.

(4) The plug for well drilling process according to any one of (1) to (3), wherein the mandrel has a tensile load capacity of at least 5 kN at a temperature of 66° C.

(5) The plug for well drilling process according to any one of (1) to (4), wherein the mandrel is formed from an aliphatic polyester containing a reinforcing material.

(6) The plug for well drilling process according to any one of (1) to (5), wherein the mandrel has a thickness reduction of less than 5 mm after immersion for one hour in water at a temperature of 66° C. and has a thickness reduction of at least 10 mm after immersion for 24 hours in water at a temperature of 149° C.

(7) The plug for well drilling process according to any one of (1) to (6), wherein the mandrel has a hollow part along the axial direction.

(8) The plug for well drilling process according to (7), wherein a ratio of an outside diameter of the hollow part of the mandrel to the diameter of the mandrel is at most 0.7.

(9) The plug for well drilling process according to any one of (1) to (8), wherein the mandrel has a locking mechanism for fixing the diameter-expandable circular rubber member to the outer peripheral surface in a compressed state.

(10) The plug for well drilling process according to (9), wherein the locking mechanism is at least one type selected from the group consisting of a groove, a stepped part, and a screw thread.

(11) The plug for well drilling process according to any one of (1) to (10), wherein a radius of curvature of a processed portion of the outer peripheral surface of the mandrel is at least 0.5 mm.

(12) The plug for well drilling process according to any one of (1) to (11), wherein the outer peripheral surface of the mandrel has an area partially protected by a metal.

(13) The plug for well drilling process according to any one of (1) to (12), wherein the mandrel and one ring of the pair of rings are formed integrally.

(14) The plug for well drilling process according to (13) formed by integral molding.

(15) The plug for well drilling process according to (13) formed by machining.

(16) The plug for well drilling process according to any one of (1) to (15), wherein the pair of rings are formed from a degradable material having a shearing stress of at least 30 MPa at a temperature of 66° C.

(17) The plug for well drilling process according to any one of (1) to (16), wherein a length of the diameter-expandable circular rubber member in the axial direction of the mandrel is from 10 to 70% with respect to a length of the mandrel.

(18) The plug for well drilling process according to any one of (1) to (17), wherein the diameter-expandable circular rubber member is provided in plurality.

(19) The plug for well drilling process according to any one of (1) to (18), wherein the diameter-expandable circular rubber member is formed from a degradable material.

(20) The plug for well drilling process according to any one of (1) to (19), wherein a slip and a wedge are not provided on the outer peripheral surface of the mandrel.

(21) The plug for well drilling process according to any one of (1) to (19) further comprising at least one combination of a slip and a wedge placed at a position between the pair of rings on the outer peripheral surface existing in the orthogonal to the axial direction of the mandrel.

(22) The plug for well drilling process according to (21), wherein one or both of the slip and wedge are formed from a degradable material.

(23) The plug for well drilling process according to (21) or (22), wherein one or both of the slip and wedge are formed from a material containing at least one of a metal or an inorganic substance.

(24) The plug for well drilling process according to any one of (21) to (23), wherein one or both of the slip and wedge are formed from a degradable material and a material containing at least one of a metal or an inorganic substance.

(25) The plug for well drilling process according to any one of (21) to (24) wherein the combination of slip and wedge is provided in plurality.

(26) The plug for well drilling process according to any one of (1) to (25), wherein a percentage of mass loss in the degradable material after immersion for 72 hours in water at a temperature of 150° C. with respect to a mass prior to immersion is from 5 to 100%.

(27) The plug for well drilling process according to any one of (1) to (26), wherein the degradable material contains a reinforcing material.

(28) The plug for well drilling process according to any one of (1) to (27), wherein the degradable material is an aliphatic polyester.

(29) The plug for well drilling process according to (28), wherein the aliphatic polyester is a polyglycolic acid.

(30) The plug for well drilling process according to (29), wherein the polyglycolic acid has a weight average molecular weight of 180,000 to 300,000 and a melt viscosity from 700 to 2,000 Pa·s when measured at a temperature of 270° C. and a shear rate of 122 $sec^{-1}$.

In addition, another aspect of the present invention provides (31) a plug for well drilling process comprising: ($a_1$) a mandrel formed from a degradable material having a tensile strength of at least 50 MPa at a temperature of 60° C., the mandrel having a thickness reduction of less than 5 mm after immersion for one hour in water at a temperature of 66° C. and having a thickness reduction of at least 10 mm after immersion for 24 hours in water at a temperature of at least 149° C.;

(b) a pair of rings placed on an outer peripheral surface existing in the orthogonal to an axial direction of the mandrel, at least one of the rings being formed from a degradable material; and (c) at least one diameter-expandable circular rubber member placed at a position between the pair of rings on the outer peripheral surface existing in the orthogonal to the axial direction of the mandrel.

In addition, the plug for well drilling process of (32) to (36) below are provided as specific embodiments of the other aspect of the present invention.

(32) The plug for well drilling process according to (31), wherein the diameter-expandable circular rubber member is formed from a degradable material.

(33) The plug for well drilling process according to (31) or (32), wherein the degradable material contains a reinforcing material.

(34) The plug for well drilling process according to any one of (31) to (33), wherein the degradable material is an aliphatic polyester.

(35) The plug for well drilling process according to (34), wherein the aliphatic polyester is a polyglycolic acid.

(36) The plug for well drilling process according to (35), wherein the polyglycolic acid has a weight average molecular weight of 180,000 to 300,000 and a melt viscosity of 700 to 2,000 Pa·s when measured at a temperature of 270° C. and a shear rate of 122 $sec^{-1}$.

In addition, another aspect of the present invention provides (37) a plug for well drilling process comprising: ($a_2$) a mandrel formed from a degradable material having a tensile strength of at least 50 MPa at a temperature of 60° C.;

(b) a pair of rings placed on an outer peripheral surface existing in the orthogonal to an axial direction of the mandrel, at least one of the rings being formed from a degradable material; and (c) at least one diameter-expandable circular rubber member placed at a position between the pair of rings on the outer peripheral surface existing in the orthogonal to the axial direction of the mandrel, a percentage of mass loss in the degradable material after immersion for 72 hours in water at a temperature of 150° C. with respect to a mass prior to immersion being from 5 to 100%.

The plug for well drilling process of (38) to (42) below are provided as specific embodiments of the yet another aspect of the present invention.

(38) The plug for well drilling process according to (37), wherein the diameter-expandable circular rubber member is formed from a degradable material.

(39) The plug for well drilling process according to (37) or (38), wherein the degradable material contains a reinforcing material.

(40) The plug for well drilling process according to any one of (37) to (39), wherein the degradable material is an aliphatic polyester.

(41) The plug for well drilling process according to (40), wherein the aliphatic polyester is a polyglycolic acid.

(42) The plug for well drilling process according to (41), wherein the polyglycolic acid has a weight average molecular weight of 180,000 to 300,000 and a melt viscosity from 700 to 2,000 Pa·s when measured at a temperature of 270° C. and a shear rate of 122 $sec^{-1}$.

In addition, yet another aspect of the present invention provides (43) a plug for well drilling process comprising: ($a_3$) a mandrel formed from a degradable material having a shearing stress of at least 30 MPa at a temperature of 66° C.;

(b) a pair of rings placed on an outer peripheral surface existing in the orthogonal to an axial direction of the mandrel, at least one of the rings being formed from a degradable material; and (c) at least one diameter-expandable circular rubber member placed at a position between the pair of rings on the outer peripheral surface existing in the orthogonal to the axial direction of the mandrel, a percentage of mass loss in the degradable material after immersion for 72 hours in water at a temperature of 150° C. with respect to a mass prior to immersion being from 5 to 100%.

The plug for well drilling process of (44) to (48) below are provided as specific embodiments of the yet another aspect of the present invention.

(44) The plug for well drilling process according to (43), wherein the diameter-expandable circular rubber member is formed from a degradable material.

(45) The plug for well drilling process according to (43) or (44), wherein the degradable material contains a reinforcing material.

(46) The plug for well drilling process according to any one of (43) to (45), wherein the degradable material is an aliphatic polyester.

(47) The plug for well drilling process according to (46), wherein the aliphatic polyester is a polyglycolic acid.

(48) The plug for well drilling process according to (47), wherein the polyglycolic acid has a weight average molecular weight of 180,000 to 300,000 and a melt viscosity of 700 to 2,000 Pa·s when measured at a temperature of 270° C. and a shear rate of 122 $sec^{-1}$.

One more aspect of the present invention provides (49) a well drilling method comprising the step of plugging a well hole using the plug for well drilling process described in any one of (1) to (48), wherein part or all of the plug for well drilling process degrades after the plugging.

Advantageous Effects of Invention

The present invention is a plug for well drilling process comprising: (a) a mandrel formed from a degradable material;

(b) a pair of rings placed on an outer peripheral surface existing in the orthogonal to an axial direction of the mandrel, at least one of the rings being formed from a degradable material; and (c) at least one diameter-expandable circular rubber member placed at a position between the pair of rings on the outer peripheral surface existing in the orthogonal to the axial direction of the mandrel.

As a result, the present invention exhibits the effect of enabling the reliable isolating and fracturing of a well hole under increasingly rigorous mining conditions such as higher depths, and being capable of reducing the cost of well drilling and shortening the process by facilitating the removal of the plug for well drilling process and the procurement of a flow path.

In addition, the present invention is a well drilling method in which part or all of the plug for well drilling process described above degrades after a well hole is plugged using the plug for well drilling process. As a result, the present invention exhibits the effect of enabling the reliable isolating and fracturing of a well hole, and being capable of reducing the cost of well drilling and shortening the process by facilitating the removal of the plug for well drilling process and the procurement of a flow path.

DESCRIPTION OF EMBODIMENTS

Figure 1A:
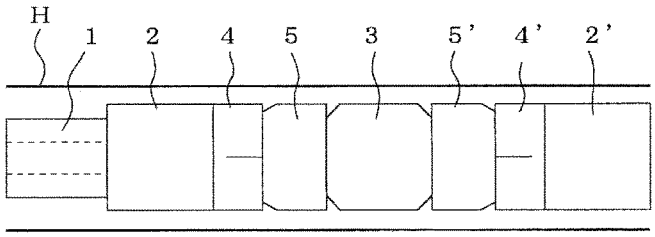
FIG. 1A is schematic view illustrating a specific example of the plug for well drilling process of the present invention.

The present invention relates to a plug for well drilling process comprising: (a) a mandrel formed from a degradable material;

(b) a pair of rings placed on an outer peripheral surface existing in the orthogonal to an axial direction of the mandrel, at least one of the rings being formed from a degradable material; and (c) at least one diameter-expandable circular rubber member placed at a position between the pair of rings on the outer peripheral surface existing in the orthogonal to the axial direction of the mandrel.

This will be described hereinafter with reference to the drawings.

1. Plug for Well Drilling Process

1. Mandrel

The plug for well drilling process of the present invention comprises: (a) a mandrel 1 (also called the "mandrel of (a)" or simply the "mandrel" hereafter) formed from a degradable material; (b) a pair of rings 2 and 2'(also called the "pair of rings of (b)" or simply the "pair of rings" hereafter) placed on an outer peripheral surface existing in the orthogonal to an axial direction of the mandrel, at least one of the rings being formed from a degradable material; and (c) at least one diameter-expandable circular rubber member 3 (also called the "diameter-expandable circular rubber member of (c) or simply the "diameter-expandable circular rubber member", and also further called the "circular rubber member" hereafter) placed at a position between the pair of rings on the outer peripheral surface existing in the orthogonal to the axial direction of the mandrel. That is, the plug for well drilling process of the present invention comprises a mandrel, the mandrel being formed from a degradable material, a pair of rings, at least one of which being formed from a degradable material, and at least one diameter-expandable circular rubber member, and further comprises slips 4 and 4' and wedges 5 and 5' as desired.

The mandrel of the (a) mandrel 1 formed from a degradable material provided in the plug for well drilling process of the present invention is ordinarily called a "core rod" and is a member having a roughly circular cross-section and a sufficiently large length with respect to the diameter of the cross section so as to basically secure the strength of the plug for well drilling process of the present invention. The diameter of the cross section of the mandrel 1 provided in the plug for well drilling process of the present invention is selected appropriately in accordance with the size of the well hole (being slightly smaller than the inside diameter of the well hole makes it possible to move inside the well hole, while the difference in diameter is such that the well hole can be isolated by the expansion in diameter of the diameter-expandable circular rubber member, as described below), and the length of the mandrel 1 may be, but is not limited to, from approximately 5 to approximately 20 times the diameter of the cross section, for example. The diameter of the cross section of the mandrel 1 is ordinarily in the range of approximately 5 to approximately 30 cm.

[Hollow Part]

The mandrel 1 provided in the plug for well drilling process of present invention may be a solid mandrel, but the mandrel 1 is preferably a hollow mandrel at least partially having a hollow part along the axial direction from the perspectives of securing a flow path at the early stage of fracturing, the reduction of the weight of the mandrel, and the control of the degradation rate of the mandrel (that is, the hollow part may pass through the mandrel along the axial direction or may not pass through the mandrel along the axial direction). In addition, when a fluid is pressed and transported into the plug for well drilling process, the mandrel 1 needs to have a hollow part along the axial direction. When the mandrel 1 has a hollow part along the axial direction, the cross-sectional shape of the mandrel 1 is a circular shape formed by two concentric circles forming the diameter (outside diameter) of the mandrel 1 and the outside diameter of the hollow part (corresponding to the inside diameter of the mandrel 1). The ratio of the diameters of the two concentric circles—that is, the ratio of the outside diameter of the hollow part to the diameter of the mandrel 1—is preferably at most 0.7. The magnitude of this ratio has a reciprocal relationship with the magnitude of the ratio of the thickness of the hollow mandrel to the diameter of the mandrel 1, so determining the upper limit of this ratio can be considered equivalent to determining a preferable lower limit of the thickness of the hollow mandrel. When the thickness of the hollow mandrel is too thin, the strength (in particular, the tensile strength) of the hollow mandrel may be insufficient when the plug for well drilling process is placed inside a well hole or at the time of well hole sealing or fracturing, which may damage the plug for well drilling process in extreme cases. Therefore, the ratio of the outside diameter of the hollow part to the diameter of the mandrel 1 is more preferably at most 0.6 and even more preferably at most 0.5.

The diameter of the mandrel 1 and/or the outside diameter of the hollow part may be uniform along the axial direction of the mandrel 1 or may vary along the axial direction. That is, convex parts, stepped parts, concave parts (grooves), or the like may be formed on the outer peripheral surface of the mandrel 1 when the outside diameter of the mandrel 1 varies along the axial direction. In addition, convex parts, stepped parts, concave parts (grooves), or the like may be formed on the inner peripheral surface of the mandrel 1 when the outside diameter of the hollow part varies along the axial direction. The convex parts, stepped parts, or concave parts (grooves) on the outer peripheral surface and/or the inner peripheral surface of the mandrel may be used as sites for attaching or fixing other members to the outer peripheral surface and/or the inner peripheral surface of the mandrel 1 and, as described below, can be used as locking mechanism for fixing the diameter-expandable circular rubber member, in particular. In addition, when the mandrel 1 has a hollow part, it may have a seat for holding a ball used to control the flow of a fluid.

[Degradable Material]

The mandrel 1 provided in the plug for well drilling process of the present invention is formed from a degradable material. The degradable material may be, for example, degradable materials having biodegradability so as to be degraded by microorganisms in the soil in which a fracturing fluid is used, and hydrolyzability so as to be degraded by a solvent in the fracturing fluid—water, in particular—and also by acids or alkalis as desired, but it may also be a degradable material that can be chemically degraded by some other method. The material is preferably a hydrolyzable material which is degraded by water at or above a prescribed temperature. In addition, a material which is physically degraded by crushing, collapsing, or the like as a result of applying a large mechanical force, as in the case of a metal material such as aluminum that is widely used as a mandrel provided in a conventional plug for well drilling process, does not fall under the category of the degradable material for forming the mandrel 1 provided in the plug for well drilling process of the present invention. However, as observed in the degradable resins described below, a material which is easily collapsed so as to lose its shape by applying a very small mechanical force as a result of the original resin decreasing in strength and becoming brittle due to a decrease in the degree of polymerization or the like does fall under the category of the degradable material described above.

[Percentage of Mass Loss after 72 Hours at 150° C.]

The percentage of mass loss in the degradable material forming the mandrel 1 provided in the plug for well drilling process of the present invention after immersion for 72 hours in water at a temperature of 150° C. with respect to a mass prior to immersion (also called the "percentage of mass loss after 72 hours at 150° C." hereafter) is from 5 to 100%. As a result, the degradable material forming the mandrel 1 is degraded, collapsed, or more preferably eliminated (also collectively called "degraded" in the present invention) within a few hours to a few weeks in a downhole (a temperature of approximately 60° C. to approximately 200° C. due to the diversification of depth; in recent years, there are also low-temperature downhole environments of approximately 25 to approximately 40° C.). Therefore, it is unnecessary to expend large amounts of time and money for the recovery or physical destruction of the mandrel 1 or the plug for well drilling process, which contributes to a reduction in the cost and a shortening of the process for recovering hydrocarbon resources. For example, when the percentage of mass loss after 72 hours at 150° C. is 100%, the mass becomes 0 after the mandrel 1 is immersed for 72 hours in water at a temperature of 150° C. This means that the mandrel has been completely eliminated, which is preferable. Since the percentage of mass loss after 72 hours at 150° C. of the mandrel 1 provided in the plug for well drilling process of the present invention is from 5 to 100%, it has the property of maintaining its strength for a certain amount of time and then degrading thereafter in various temperature environments of the downhole such as a temperature of 177° C. (350° F.), 163° C. (325° F.), 149° C. (300° F.), 121° C. (250° F.), 93° C. (200° F.), 80° C., 66° C., or from 25 to 40° C. It is therefore possible to select an optimal material from degradable materials for forming the mandrel 1 having a percentage of mass loss after 72 hours at 150° C. of from 5 to 100% in accordance with the environment or process of the downhole.

Although also dependent on the magnitude of the value of the original mass (called the "mass measured prior to being immersed in water at a temperature of 150° C."), the percentage of mass loss after 72 hours at 150° C. of the degradable material forming the mandrel 1 provided in the plug for well drilling process of the present invention is preferably from 10 to 100%, more preferably from 20 to 100%, even more preferably from 50 to 100%, and particularly preferably from 80 to 100% from the perspective of having superior degradability (disintegrability) (degrading in a desired short amount of time). The degradable material forming the mandrel 1 of the present invention may also be designed/prepared as necessary so that the percentage of mass loss after 72 hours at 150° C. is 100% and so that the percentage of the mass loss after immersion for 72 hours in water at various temperatures such as 93° C. or 66° C. with respect to the original mass is at most 20%, at most 10%, or less than 5%, for example.

The method for measuring the percentage of mass loss after 72 hours at 150° C. of the degradable material forming the mandrel 1 is as follows. Specifically, a sample cut out to a respective thickness, length, and width of 20 mm directly from the mandrel 1 or from a preform or the like for forming the mandrel 1 is immersed in 400 mL of water (deionized water or the like) at a temperature of 150° C. The mass of the sample measured after being extracted once 72 hours has passed and the mass of the sample measured in advance prior to immersion in water at a temperature of 150° C. ("original mass") are compared, and the percentage of mass loss (units: %) with respect to the original mass is calculated.

[Thickness Reduction after Immersion in Water]

In addition, the reduction in thickness of the mandrel 1 formed from a degradable material in the plug for well drilling process of the present invention after immersion for one hour in water at a temperature of 66° C. is preferably less than 5 mm, and the reduction in thickness after immersion for 24 hours in water at a temperature of 149° C. is preferably at least 10 mm. That is, by setting the reduction in thickness of the mandrel 1 after immersion for one hour in water at a temperature of 66° C. to less than 5 mm, more preferably less than 4 mm, and even more preferably less than 3 mm, the probability that the degradable material forming the mandrel 1 will be degraded (as described above, the mandrel may be collapsed or reduced in strength) in a downhole environment at a temperature of 66° C. is small, so the shape and size of the mandrel 1 are almost completely maintained, and the engagement between the pair of rings attached to the outer peripheral surface existing in the orthogonal to the axial direction of the mandrel 1 and other members is reliably maintained. Therefore, well treatment such as fracturing, wherein a large pressure facing the axial direction of the mandrel 1 is received due to a fluid, can be performed reliably in accordance with a desired time schedule of a few hours to a few days, for example. At the same time, by setting the reduction in thickness of the mandrel 1 after immersion for 24 hours in water at a temperature of 149° C. to at least 10 mm, more preferably at least 12 mm, and even more preferably at least 15 mm, the degradable material forming the mandrel 1 is degraded (as described above, the mandrel may be collapsed or reduced in strength) when the mandrel 1 is brought into contact with a fluid at a temperature of 149° C., for example, after well treatment such as fracturing is completed, which makes it possible to accelerate the degradation of the plug for well drilling process.

[Degradable Resins]

The degradable material forming the mandrel 1 provided in the plug for well drilling process of the present invention needs to have a prescribed strength and excellent degradability in a high-temperature, high-pressure environment deep underground, and a degradable resin is preferable. A degradable resin refers to a resin which is biodegradable, hydrolyzable, or can be chemically degraded by another method, as described above. Examples of degradable resins include aliphatic polyesters such as polylactic acid, polyglycolic acid, poly-ϵ-caprolactone, and polyvinyl alcohol (partially saponified polyvinyl alcohol or the like with a degree of saponification of approximately 80 to approximately 95 mol %, and aliphatic polyesters are preferable. That is, the degradable material is preferably an aliphatic polyester. The degradable resin may be used alone or in combinations of two or more types by means of blending or the like.

[Aliphatic Polyesters]

An aliphatic polyester is an aliphatic polyester obtained, for example, by the homopolymerization or copolymerization of an oxycarboxylic acid and/or a lactone, an esterification reaction between an aliphatic dicarboxylic acid and an aliphatic diol, or the copolymerization of an aliphatic dicarboxylic acid, an aliphatic diol, an oxycarboxylic acid, and/or a lactone, and a substance which dissolves rapidly in water at a temperature of approximately 20 to approximately 100° C. is preferable.

Examples of oxycarboxylic acids include aliphatic hydroxycarboxylic acids having from 2 to 8 carbon atoms such as glycolic acid, lactic acid, malic acid, hydroxypropionic acid, hydroxybutyric acid, hydroxypentanoic acid, hydroxycaproic acid, hydroxyheptanoic acid, and hydroxyoctanoic acid.

Examples of lactones include lactones having from 3 to 10 carbon atoms such as propiolactone, butyrolactone, valerolactone, and ϵ-caprolactone.

Examples of aliphatic dicarboxylic acids include aliphatic saturated dicarboxylic acids having from 2 to 8 carbon atoms such as oxalic acid, malonic acid, succinic acid, glutaric acid, and adipic acid and aliphatic unsaturated dicarboxylic acids having from 4 to 8 carbon atoms such as maleic acid and fumaric acid.

Examples of aliphatic diols include alkylene glycols having from 2 to 6 carbon atoms such as ethylene glycol, propylene glycol, butanediol, and hexanediol and polyalkylene glycols having from 2 to 4 carbon atoms such as polyethylene glycol, polypropylene glycol, and polybutylene glycol.

The components forming these polyesters may be respectively used alone or in combinations of two or more types. In addition, components forming aromatic polyesters such as terephthalic acid may also be used in combination as long as the properties of the degradable resin are not diminished.

Examples of particularly preferable aliphatic polyesters include hydroxycarboxylic acid-based aliphatic polyesters such as polylactic acid (also called "PLA" hereafter) and polyglycolic acid (also called "PGA" hereafter); lactone-based aliphatic polyesters such as poly-ϵ-caprolactone (also called "PCL" hereafter); diol/dicarboxylic acid-based aliphatic polyesters such as polyethylene succinate and polybutylene succinate; copolymers thereof such as glycolic acid/lactic acid copolymers (also called "PGLA" hereafter); and mixtures thereof. Additional examples include aliphatic polyesters using aromatic components such as polyethylene adipate/terephthalate in combination.

From the perspective of the strength or degradability required of the mandrel provided in the plug for well drilling process, the aliphatic polyester is most preferably at least one type selected from the group consisting of PGA, PLA, and PGLA, and PGA is even more preferable. In addition to homopolymers of glycolic acids, PGAs include copolymers having glycolic acid repeating units in amounts of at least 50 mass %, preferably at least 75 mass %, more preferably at least 85 mass %, even more preferably at least 90 mass %, particularly preferably at least 95 mass %, most preferably at least 99 mass %, and especially preferably at least 99.5 mass %. In addition to homopolymers of L-lactic acids or D-lactic acids, PLAs include copolymers having L-lactic acid or D-lactic acid repeating units in amounts of at least 50 mass %, preferably at least 75 mass %, more preferably at least 85 mass %, and even more preferably at least 90 mass %. Copolymers having a ratio (mass ratio) of glycolic acid repeating units to lactic acid repeating units of 99:1 to 1:99, preferably from 90:10 to 10:90, and more preferably from 80:20 to 20:80 can be used as PGLAs.

(Melt Viscosity)

Substances having a melt viscosity of ordinarily from 50 to 5,000 Pa·s, preferably from 150 to 3,000 Pa·s, and more preferably from 300 to 1,500 Pa·s as measured at a temperature of 240° C. and a shear rate of 122 $sec^{-1}$ can be used as aliphatic polyesters and preferably a PGA, PLA, or PGLA. When the melt viscosity is too small, the strength required of the mandrel provided in the plug for well drilling process may be insufficient. When the melt viscosity is too large, a high melting temperature becomes necessary to produce the mandrel, for example, which may lead to a risk that the aliphatic polyester may undergo thermal degradation or may cause the degradability to be insufficient. The melt viscosity described above is measured under conditions with a shear rate of 122 $sec^{-1}$ after approximately 20 g of a PGA sample is held for 5 minutes at a prescribed temperature using a capillograph equipped with a capillary (diameter: 1 mmϕ×length: 10 mm) ("Capillograph 1-C" manufactured by Toyo Seiki Seisaku-sho, Ltd.).

As a PGA serving as a particularly preferable aliphatic polyester, a PGA having a weight average molecular weight of 180,000 to 300,000 and having a melt viscosity of 700 to 2,000 Pa·s as measured at a temperature of 270° C. and a shear rate of 122 $sec^{-1}$ is more preferable from the perspective of moldability in that cracks are unlikely to form when molding is performed by solidifying extrusion molding. Of these, a preferable PGA is a PGA having a weight average molecular weight of 190,000 to 240,000 and a melt viscosity of 800 to 1,200 Pa·s when measured at a temperature of 270° C. and a shear rate of 122 $sec^{-1}$. The melt viscosity is measured in accordance with the method described above. The weight average molecular weight described above is measured by gel permeation chromatography (GPC) under the following conditions using 10 μl of a sample solution obtained by dissolving 10 mg of a PGA sample in hexafluoroisopropanol (HFIP) in which sodium trifluoroacetate was dissolved at a concentration of 5 mM and then filtering the solution with a membrane filter.

<GPC Measurement Conditions>

Apparatus: Shimadzu LC-9A manufactured by the Shimadzu Corporation

Columns: two HFIP-806M columns (connected in series)+ one HFIP-LG precolumn manufactured by Showa Denko K.K.

Column Temperature: 40° C.

Eluent: HFIP solution in which sodium trifluoroacetate is dissolved at a concentration of 5 mM Flow rate: 1 mL/min Detector: differential refractometer Molecular weight calibration: data of a molecular weight calibration curve produced by using five types of polymethylmethacrylates having standard molecular weights that are different from each other (manufactured by POLYMER LABORATORIES Ltd.) is used.

[Other Compounded Components]

Various additives such as resin materials (other resins in the case that the degradable material is a degradable resin), stabilizers, degradation accelerators, degradation inhibitors, or reinforcing materials may be added to or blended into the degradable material, preferably a degradable resin, more preferably an aliphatic polyester, and even more preferably PGA as other compounded components within a range that does not inhibit the objective of the present invention. The degradable material preferably contains a reinforcing material, and in this case, the degradable material may be a composite material. When the degradable material is a degradable resin, it is a so-called reinforced resin. A mandrel formed from a reinforced resin is preferably formed from an aliphatic polyester containing a reinforcing material.

[Reinforcing Material]

A material conventionally used as a reinforcing material such as a resin material for the purpose of enhancing mechanical strength or heat resistance can be used as a reinforcing material, and fibrous, granular, or powdered reinforcing materials may be used. The reinforcing material may be contained in an amount within a range of ordinarily at most 150 parts by mass and preferably from 10 to 100 parts by mass per 100 parts by mass of the degradable material such as a degradable resin.

Examples of fibrous reinforcing materials include inorganic fibrous substances such as glass fibers, carbon fibers, asbestos fibers, silica fibers, alumina fibers, zirconia fibers, boron nitride fibers, silicon nitride fibers, boron fibers, and potassium titanate fibers; metal fibrous substances such as stainless steel, aluminum, titanium, steel, and brass; and organic fibrous substances with a high melting point such as aramid fibers, kenaf fibers, polyamides, fluorine resins, polyester resins, and acrylic resins; and the like. Short fibers having a length of 10 mm or less, more preferably 1 to 6 mm, and even more preferably 1.5 to 4 mm are preferable as the fibrous reinforcing material. Furthermore, inorganic fibrous substances are preferably used, and glass fibers are particularly preferable.

As the granular or powdered reinforcing material, mica, silica, talc, alumina, kaolin, calcium sulfate, calcium carbonate, titanium oxide, ferrite, clay, glass powder, zinc oxide, nickel carbonate, iron oxide, quartz powder, magnesium carbonate, barium sulfate, and the like can be used. Reinforcing materials may be respectively used alone or in combinations of two or more types. The reinforcing material may be treated with a sizing agent or surface treatment agent as necessary.

[Tensile Strength at 60° C.]

The mandrel 1 provided in the plug for well drilling process of the present invention is preferably formed from a degradable material having a tensile strength at a temperature of 60° C. (also called the "tensile strength at 60° C.") of at least 50 MPa. Therefore, ($a_2$) a mandrel formed from a degradable material having a tensile strength at 60° C. of at least 50 MPa is a preferable embodiment, and ($a_1$) a mandrel formed from a degradable material having a tensile strength at 60° C. of at least 50 MPa, the mandrel having a thickness reduction of less than 5 mm after immersion for one hour in water at a temperature of 66° C. and having a thickness reduction of at least 10 mm after immersion for 24 hours in water at a temperature of at least 149° C., is also a preferable embodiment. Since the mandrel 1 of the plug for well drilling process of the present invention is made of a degradable material having a tensile strength at 60° C. of at least 50 MPa, the plug for well drilling process can have sufficient strength to withstand the tensile stress applied to the mandrel 1 in an environment at a temperature of 60° C., which is typical in a shale gas layer, for example, or a high-temperature environment exceeding a temperature of 100° C. in the earth at an underground depth exceeding 3,000 m. The tensile strength at 60° C. of the degradable material forming the mandrel 1 is measured in accordance with JIS K7113, and the tensile strength is measured while a sample piece is left in an oven to set the test temperature to 60° C. (unit: MPa). The tensile strength at 60° C. of the degradable material forming the mandrel 1 is preferably at least 75 MPa and more preferably at least 100 MPa. In order to ensure that the degradable material forming the mandrel 1 has a tensile strength at 60° C. of at least 50 MPa, a method of adjusting the type or properties (melt viscosity, molecular weight, or the like) of the degradable material such as a degradable resin, for example, or the types, properties, added amounts, or the like of additives such as a reinforcing material may be used. The upper limit of the tensile strength at 60° C. is not particularly limited but is ordinarily 1,000 MPa and is 750 MPa in many cases.

[Shearing Stress at a Temperature of 66° C.]

The mandrel 1 provided in the plug for well drilling process of the present invention is preferably formed from a degradable material having a shearing stress at a temperature of 66° C. of at least 30 MPa. In addition, ($a_3$) a mandrel formed from a degradable material having a shearing stress of at least 30 MPa at a temperature of 66° C. is a preferable embodiment. That is, since the mandrel 1 is formed from a degradable material having a shearing stress of at least 30 MPa at a temperature of 66° C., it is possible to ensure that the engagement between an engagement part and a jig for pulling and/or compressing the mandrel 1 (for example, a screw part or a diameter-expanded part of the mandrel) or an engagement part and the pair of rings or other members attached to the outer peripheral surface existing in the orthogonal to the axial direction of the mandrel 1 when undergoing a large pressure facing the axial direction of the mandrel due to a fracturing fluid or the like. The load capacity of the engagement part depends on the area of the engagement part and the magnitude of the shearing stress of the material having the smaller shearing stress in the temperature environment where the engagement part is located among the materials constituting the engagement part. However, by forming the mandrel 1 from a degradable material having a shearing stress of at least 30 MPa at a temperature of 66° C., it is possible to ensure that the load capacity of the engagement part at a temperature of 66° C. is sufficiently large. As a result, well treatment such as fracturing, in which a large pressure facing the axial direction of the mandrel 1 is received due to a fluid, can be performed reliably in accordance with a desired time schedule of a few hours to a few days, for example. The shearing stress of the degradable material forming the mandrel 1 at a temperature of 66° C. is preferably at least 45 MPa and more preferably at least 60 MPa. The upper limit of the shearing stress of the degradable material at a temperature of 66° C. is not particularly limited but is ordinarily at most 600 MPa and is at most 450 MPa in many cases.

[Tensile Load Capacity at a Temperature of 66° C.]

The mandrel 1 provided in the plug for well drilling process of the present invention preferably has a tensile load capacity of at least 5 kN at a temperature of 66° C. Therefore, the degradable material is preferably selected and designed so that the tensile load capacity at a temperature of 66° C. is at least 5 kN. In order to operate the plug for well drilling process of the present invention—that is, to realize the function thereof by expanding the diameter of a diameter-expandable circular rubber member and more preferably the slip—a load is ordinarily applied so as to press the members attached to the outer peripheral surface existing in the orthogonal to the axial direction of the mandrel 1 to the ring 2' side illustrated in FIGS. 1A to 2B with respect to the mandrel 1. Therefore, a high tensile load of approximately 20 to approximately 1,000 kN or, in many cases, from approximately 25 to approximately 800 kN is applied to the mandrel 1. In addition, both ends of the mandrel 1 are provided with screw parts, diameter-expanded parts, or the like so that a jig for pulling and/or compressing the mandrel 1 can be engaged, but 2- to 5-fold stress concentration occurs in the screw parts, diameter-expanded parts, or the like (engagement part with the jig) in accordance with the design. Therefore, it is necessary to select a material (degradable material) having strength capable of withstanding such a high load as the mandrel 1 and to ensure that the stress concentration is small in the design. In addition, when undergoing a large pressure facing the axial direction of the mandrel due to a fracturing fluid or the like, a high load is also applied to the engagement part with the pair of rings and other members attached to the outer peripheral surface existing in the orthogonal to the axial direction of the mandrel 1, so a similar material selection and design are necessary. The tensile load capacity of the mandrel 1 at a temperature of 66° C. is preferably at least 15 kN, more preferably at least 30 kN, and particularly preferably at least 40 kN from the perspective of sufficiently withstanding a high load. The upper limit of the tensile load capacity of the mandrel 1 at a temperature of 66° C. is not particularly limited but is ordinarily at most 1,500 kN and in many cases at most 1,200 kN from the perspective of the selection of a material having degradability.

[Locking Mechanism]

As described above, the mandrel 1 may have convex parts, stepped parts, concave parts (grooves), or the like on the outer peripheral surface. These can be used as sites for attaching or fixing other members and, in particular, as locking mechanism for fixing the diameter-expandable circular rubber member 3.

As described in detail below, the plug for well drilling process of the present invention comprises at least one diameter-expandable circular rubber member 3 placed at a position between the pair of rings 2 and 2' on the outer peripheral surface existing in the orthogonal to the axial direction of the mandrel 1. The diameter-expandable circular rubber member 3 expands in diameter in the direction orthogonal to the axial direction as it is compressed and reduced in diameter in the axial direction of the mandrel 1. The circular rubber member 3 expands in diameter so that the outer part in the direction orthogonal to the axial direction makes contact with the inside wall H of the well hole, and the inner part in the direction orthogonal to the axial direction makes contact with the outer peripheral surface of the mandrel 1 so as to isolate (seal) the space between the plug and the well hole. Next, it is necessary for the seal between the plug and the well hole to be maintained while fracturing is performed, so the (c) diameter-expandable circular rubber member 3 needs to be held by some means in a compressed state—that is, in a compressed state in the axial direction of the mandrel 1—and in an expanded state in the direction orthogonal to the axial direction of the mandrel 1.

The mandrel 1 may have convex parts, stepped parts, concave parts (grooves), or the like on the outer peripheral surface, and the mandrel 1 provided in the plug for well drilling process of the present invention preferably has a locking mechanism for fixing the diameter-expandable circular rubber member 3 to the outer peripheral surface in the compressed state. This locking mechanism may be a convex part, stepped part, or concave part (groove) as described above, or a screw part or another means capable of fixing the diameter-expandable circular rubber member 3 to the outer peripheral surface of the mandrel 1 in the compressed state can be used. From the perspective of the ease of processing or molding, strength, or the like, the locking mechanism is more preferably at least one type selected from the group consisting of a groove, stepped part, and a screw thread.

[Processed Portions]

The portions where the thickness, outside diameter, inside diameter, and the like of the mandrel 1 vary, such as the convex parts, stepped parts, concave parts (grooves), and screw parts on the outer peripheral surface and/or the inner peripheral surface of the mandrel 1 (also called "processed portions" hereafter) are locations where stress is concentrated when the plug for well drilling process of the present invention is placed inside the well hole or at the time of well hole sealing or fracturing. Since the stress concentration is larger when the radius of curvature of the processed portions is smaller, the radius of curvature of the processed portions on the outer peripheral surface of the mandrel 1 is preferably at least 0.5 mm and more preferably at least 1.0 mm in order to ensure that the strength (in particular, the tensile strength) of the plug for well drilling process and the mandrel 1, in particular, is sufficient.

(Metal Protection)

The mandrel 1 formed from a degradable material provided in the plug for well drilling process of the present invention may be configured so that part of the outer peripheral surface is partially protected by a metal as desired. That is, when the outer peripheral surface of the mandrel 1 has a location protected by a metal, the degradability or strength of a desired location of the mandrel 1 formed from the degradable material can be adjusted, and the bond strength with other members attached or fixed to the mandrel 1 can be increased, which is preferable. The metal used to protect the outer peripheral surface of the mandrel 1 is the material used to form the mandrel 1 provided in the plug for well drilling process or a metal or the like used for the reinforcement thereof and is not particularly limited, but specific examples include aluminum, iron, and nickel.

2. Rings

The plug for well drilling process of the present invention comprises (b) a pair of rings 2 and 2' placed on an outer peripheral surface existing in the orthogonal to the axial direction of the mandrel, at least one of the rings being formed from a degradable material.

Figure 1B:
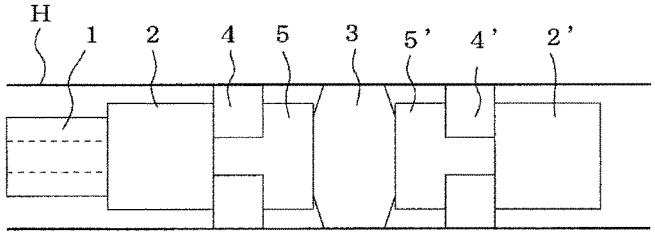
FIG. 1B is a schematic view illustrating a state in which the diameter-expandable circular rubber member of the plug for well drilling process of FIG. 1A has expanded in diameter.

The pair of rings 2 and 2' are provided to apply a force in the axial direction of the mandrel 1 to the diameter-expandable circular rubber member 3 placed on the outer peripheral surface existing in the orthogonal to the axial direction of the mandrel 1 and combinations of slips 4 and 5 placed as desired (in FIGS. 1A and 1B, a combination of slips 4 and 4' and wedges 5 and 5'). That is, the (b) pair of rings 2 and 2' are configured so that they can slide along the axial direction of the mandrel 1 on the outer peripheral surface of the mandrel 1 and so that the spacing therebetween can be changed. In addition, they are configured so that a force in the axial direction of the mandrel 1 can be applied to the diameter-expandable circular rubber member 3 and/or combinations of the slips 4 and 4' and the wedges 5 and 5' placed as desired by coming into contact directly or indirectly with the end part along the axial direction of these components.

The shape or size of each ring of the pair of rings 2 and 2' is not particularly limited as long as they fulfill the functions described above, but from the perspective of being able to effectively apply a force in the axial direction of the mandrel 1 to the diameter-expandable circular rubber member 3 and/or combinations of the slips 4 and 4' and the wedges 5 and 5' placed as necessary, the end surface on the side making contact with these components of the rings preferably has a flat shape. Each ring of the pair of rings 2 and 2' is preferably a circular ring which completely surrounds the outer peripheral surface of the mandrel (core rod) 1, but it may also have breaks or deformed spots in the circumferential direction. In addition, as a shape in which the circle is separated in the circumferential direction, the circle may be formed as desired. A plurality of each of the rings of the pair of rings 2 and 2' may be placed adjacently in the axial direction so as to form a wide ring (with a large length in the axial direction of the mandrel 1). These may be considered rings for forming the (b) pair of rings 2 and 2' in the plug for well drilling process of the present invention, including members which contribute to effectively applying a force in the axial direction of the mandrel 1 to the diameter-expandable circular rubber member 3 and/or combinations of the slips 4 and 4' and the wedges 5 and 5' placed as desired.

The pair of rings 2 and 2' may have the same or similar shapes or structures, or the shapes or structures may be different. For example, each ring of the pair of rings 2 and 2' may differ in outside diameter or length in the axial direction of the mandrel 1. In addition, one of the rings of the pair of rings 2 and 2' may be in a state in which it cannot slide with respect to the mandrel 1 as desired, for example. In this case, the other ring of the pair of rings 2 and 2' slides over the outer peripheral surface of the mandrel 1 and comes into contact with the end part along the axial direction of the diameter-expandable circular rubber member 3 and/or combinations of the slips 4 and 4' and the wedges 5 and 5' placed as desired. The configuration in which one of the rings of the pair of rings 2 and 2' cannot slide with respect to the mandrel 1 as desired is not particularly limited, but, for example, the mandrel 1 and one of the pair of rings 2 and 2' may be formed integrally (in this case, the ring in question can never slide with respect to the mandrel 1), or a clutch structure such as a dog clutch or a fitting structure may be used (in this case, it is possible to switch between a state in which the ring can slide with respect to the mandrel 1 and a state in which the ring cannot slide with respect to the mandrel 1). As a plug for well drilling process in which the mandrel 1 and one of the rings of the pair of rings 2 and 2' are formed integrally, a plug for well drilling process formed by integral molding or a plug for well drilling process formed by machining is provided.

Furthermore, the plug for well drilling process of the present invention may comprise a plurality of (b) pairs of rings 2 and 2'. In this case, at least one of each of the diameter-expandable circular rubber member 3 and/or combinations of the slips 4 and 4' and the wedges 5 and 5' placed as desired may be placed, individually or in combination, at positions between the plurality of pairs of rings.

[Degradable Material]

At least one ring of the (b) pair of rings 2 and 2' is formed from a degradable material, and it is preferable for both rings to be formed from a degradable material. The same degradable materials as those described for the mandrel 1 of (a) above can be used as the degradable material forming at least one of the rings of the pair of rings 2 and 2'. Therefore, the degradable material forming at least one of the rings of the pair of rings 2 and 2' is preferably a degradable resin, more preferably an aliphatic polyester, and even more preferably a polyglycolic acid. In addition, the degradable material may be a material containing a reinforcing material and may be formed from an aliphatic polyester containing a reinforcing material, in particular. The degradable material is preferably formed from a degradable material having a shearing stress of at least 30 MPa at a temperature of 66° C. and is even more preferably formed from a degradable material having a shearing stress of at least 45 MPa or at least 60 MPa.

When both of the rings of the pair of rings 2 and 2' of (b) are formed from a degradable material, the types or compositions of the resins of the degradable materials may be the same or different. When one of the pair of rings 2 and 2' is formed from a degradable material, a metal such as aluminum or iron or a composite material of a reinforcing resin or the like can be used as the material for forming the other ring.

3. Diameter-Expandable Circular Rubber Member

The plug for well drilling process of the present invention comprises (c) at least one diameter-expandable circular rubber member 3 placed at a position between the pair of rings 2 and 2' on the outer peripheral surface existing in the orthogonal to the axial direction of the mandrel 1. When the diameter-expandable circular rubber member 3 comes into contact directly or indirectly with the pair of rings 2 and 2', the force in the axial direction of the mandrel 1 is transmitted over the outer peripheral surface of the mandrel 1. As a result, the diameter-expandable circular rubber member 3 expands in the direction orthogonal to the axial direction of the mandrel 1 as it is compressed and reduced in diameter in the axial direction of the mandrel 1. The circular rubber member 3 expands in diameter so that the outer part in the direction orthogonal to the axial direction makes contact with the inside wall H of the well hole, and the inner part in the direction orthogonal to the axial direction makes contact with the outer peripheral surface of the mandrel 1 so as to isolate (seal) the space between the plug and the well hole. The diameter-expandable circular rubber member 3 can maintain a state of contact with the inside wall H of the well hole and the outer peripheral surface of the mandrel 1 while fracturing is subsequently performed, which yields the function of maintaining the seal between the plug and the well hole.

The diameter-expandable circular rubber member 3 of (c) is not limited with regard to its material, shape, or structure as long as it has the function described above. For example, by using a circular rubber member 3 having a shape in which the cross section in the circumferential direction orthogonal to the axial direction of the mandrel 1 has an inverted U-shape, it is possible to expand in diameter toward the vertex part of the inverted U-shape as the tip portion of the U-shape is compressed in the axial direction of the mandrel 1.

The diameter-expandable circular rubber member 3 comes into contact with the inside wall H of the well hole when expanded in diameter so as to isolate (seal) the space between the plug and the well hole, and a gap is present between the plug and the well hole when the diameter-expandable circular rubber member 3 is not expanded. Therefore, the length of the diameter-expandable circular rubber member 3 in the axial direction of the mandrel 1 is preferably from 10 to 70% and more preferably from 15 to 65% with respect to the length of the mandrel 1. As a result, the plug for well drilling process of the present invention has a sufficient sealing function, which yields a function of assisting to fix the well hole and the plug after sealing.

In this case, the plug for well drilling process of the present invention may comprise a plurality of diameter-expandable circular rubber members 3. As a result, the space between the plug and the well hole can be isolated (sealed) at a plurality of positions, and the function of assisting to fix the well hole and the plug can be achieved even more reliably. When the plug for well drilling process of the present invention is provided with a plurality of diameter-expandable circular rubber members 3, the length of the diameter-expandable circular rubber members 3 in the axial direction of the mandrel 1 described above refers to the total of the lengths of the plurality of diameter-expandable circular rubber members 3 in the axial direction of the mandrel 1. When the plug for well drilling process of the present invention comprises a plurality of diameter-expandable circular rubber members 3, the diameter-expandable circular rubber members 3 may have the same materials, shapes, or structures, or they may be different. In addition, a plurality of diameter-expandable circular rubber members 3 may be placed adjacently or at a distance from one another at positions between the pair of rings 2 and 2' or may be placed at positions between each pair of a plurality of pairs of rings 2 and 2'.

The diameter-expandable circular rubber member 3 may be a rubber member with a structure formed from a plurality of rubber members such as a laminated rubber. In addition, the diameter-expandable circular rubber member 3 may comprise one or more grooves, convex parts, rough surfaces (corrugation), or the like at the parts making contact with the inside wall H of the well hole in order to further ensure the isolating (sealing) of the space between the plug and the well hole and the assistance of the fixing of the well hole and the plug at the time of diameter expansion.

The diameter-expandable circular rubber member 3 is required not to exhibit any loss of sealing function even as a result of contact with even higher pressures or fracturing fluids associated with fracturing in high-temperature and high-pressure environments deep underground. Therefore, a rubber material having excellent heat resistance, oil resistance, and water resistance is preferable. For example, nitrile rubbers, hydrogenated nitrile rubbers, acrylic rubbers, and the like can be used.

[Degradable Material]

Furthermore, the diameter-expandable circular rubber member 3 of (c) may also be formed from a degradable material. As a rubber serving as a degradable material, it is possible to use a conventionally known material as a biodegradable rubber, a hydrolyzable rubber, or degradable rubber that can be chemically degraded by some other method, as described above. Examples include aliphatic polyester rubbers, polyurethane rubbers, natural rubbers, and polyisoprene.

4. Slips and Wedges

The plug for well drilling process of the present invention may further comprise, as necessary, (a) at least one combination of a slip 4 and a wedge 5 placed at a position between the pair of rings 2 and 2' on the outer peripheral surface existing in the orthogonal to the axial direction of the mandrel 1. The combinations of the slips 4 and the wedges 5 are themselves well known as means for fixing the plug and the well hole in the plug for well drilling process. That is, slips 4 formed from a metal, inorganic product, or the like are often placed in slidable contact with the sloping upper surfaces of the wedges 5 formed from a composite material or the like, and when a force in the axial direction of the mandrel 1 is applied to the wedges 5 by the method described above, the slips 4 move outward in a direction orthogonal to the axial direction of the mandrel 1 so as to make contact with the inside wall H of the well hole and to fix the plug and the inside wall H of the well hole. The slips 4 may comprise one or more grooves, convex parts, rough surfaces (corrugation), or the like at the parts making contact with the inside wall H of the well hole in order to further ensure the isolating (sealing) of the space between the plug and the well hole. In addition, the slips 4 may be divided into a prescribed number in the circumferential direction orthogonal to the axial direction of the mandrel 1 or, as illustrated in FIG. 1, or may have notches beginning at one end along the axial direction and ending at an intermediate point in the direction of the other end without being divided into a prescribed number (in this case, a force in the axial direction of the mandrel 1 is applied to the wedges 5, and the wedges 5 penetrate into the lower surfaces of the slips 4 so that the slips 4 are divided along the notches and the extended lines thereof, and each divided piece then moves outward in a direction orthogonal to the axial direction of the mandrel 1).

In the plug for well drilling process of the present invention, the combinations of the slips 4 and the wedges 4 are placed at positions between the pair of rings 2 and 2' and may be placed adjacent to the diameter-expandable circular rubber member 3 so that a force in the axial direction of the mandrel 1 can be applied. As illustrated in FIG. 1, the plug for well drilling process of the present invention may comprise a plurality of combinations of slips 4 and wedges 5, and in this case, they may be placed adjacently so as to sandwich the diameter-expandable circular rubber member 3, or they may be placed at other positions. When the plug for well drilling process of the present invention comprises a plurality of diameter-expandable circular rubber members 3, the arrangement of the combinations of slips 4 and 4' and wedges 5 and 5' can be selected appropriately as desired.

[Degradable Material]

When the plug for well drilling process of the present invention comprises a combination of slips 4 and 4' and wedges 5 and 5', one or both of the slips 4 and 4' or wedges 5 and 5' may be formed from a degradable material, or one or both of the slips 4 and 4' or wedges 5 and 5' may be a composite material (reinforced resin) containing a reinforcing material. Further, a member made of a metal or an inorganic substance may be incorporated into the degradable material. The materials described above can be used as a degradable material or a reinforcing material.

Therefore, one or both of the slips 4 and 4' or wedges 5 and 5' may be formed from a degradable material or, as in conventional cases, may be formed from a material containing at least one type of a metal or an inorganic substance. Further, one or both of the slips 4 and 4' or wedges 5 and 5' may be such that a member made of a metal or an inorganic substance is incorporated into a degradable material. That is, they may be formed from a degradable material and a material containing at least one type of a metal or an inorganic substance (composite material of a degradable material and a metal or an inorganic substance).

Specific examples of the slips 4 and 4' or wedges 5 and 5' serving as composite materials of a degradable material and a metal or an inorganic substance include slips 4 and 4' or wedges 5 and 5' formed by providing indentations of prescribed shapes in a parent material made of a degradable material such as a degradable resin (such as PGA), fitting a metal (metal piece or the like) or an inorganic substance of a shape conforming to the shape of the indentations, and fixing the components with an adhesive or fixing the components by winding wires, fibers, or the like so that the metal piece or the inorganic substance and the parent material can be maintained in a fixed state. This combination of slips 4 and 4' and wedges 5 and 5' causes the parent material of the slips 4 and 4' to run onto the wedges 5 and 5' so that the metal piece or inorganic substance makes contact with the inside wall H of the well hole, which yields a function of fixing the plug for well drilling process to the inside of the well.

[Plug for Well Drilling Process not Comprising Slips and Wedges]

Figure 2A:
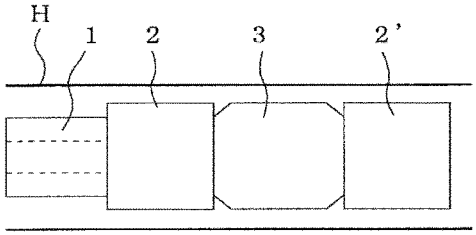
FIG. 2A is schematic view illustrating another specific example of the plug for well drilling process of the present invention.
Figure 2B:
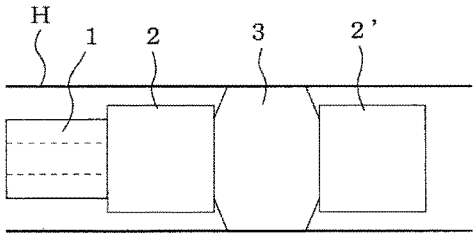
FIG. 2B is a schematic view illustrating a state in which the diameter-expandable circular rubber member of the plug for well drilling process of FIG. 2A has expanded in diameter.

As described above, the mandrel 1, the pair of rings 2 and 2', the diameter-expandable circular rubber member 3, and the combination of slips 4 and 4' and wedges 5 and 5' of the plug for well drilling process of the present invention may be formed from a degradable material. On the other hand, as illustrated in FIGS. 2A and 2B, the plug for well drilling process of the present invention may be prepared so as not to comprise a slip 4 and a wedge 5 on the outer peripheral surface of the mandrel 1. That is, metals or composite materials were often used conventionally as the slip 4 and wedge 5 from the perspective of strength or the like, but since the plug for well drilling process of the present invention comprises (a) a mandrel 1 formed from a degradable material, (b) a pair of rings 2 and 2', and (c) a diameter-expandable circular rubber member 3, it is possible to provide a plug for well drilling process having a desired strength (tensile strength or the like) for the plug for well drilling process and isolating performance between the plug and the well hole, and having excellent degradability. Therefore, by using a configuration of not comprising a slip 4 and a wedge 5, in which metals or composite materials without degradability are widely used, it is possible to simplify the structure of the plug for well drilling process and to further enhance the degradability of the entire plug for well drilling process.

5. Plug for Well Drilling Process

The plug for well drilling process of the present invention is a plug for well drilling process comprising: (a) a mandrel 1 formed from a degradable material; (b) a pair of rings 2 and 2' placed on an outer peripheral surface existing in the orthogonal to an axial direction of the mandrel, at least one of the rings being formed from a degradable material; and (c) at least one diameter-expandable circular rubber member 3 placed at a position between the pair of rings 2 and 2' on the outer peripheral surface existing in the orthogonal to the axial direction of the mandrel 1. The plug for well drilling process of the present invention may comprise members ordinarily provided in plug for well drilling process in addition to the combinations of slips 4 and wedges 5 described above. For example, when the mandrel 1 of (a) has a hollow part along the axial direction, the mandrel 1 may comprise a ball (which may be formed from a material such as a metal or resin or may be formed from a degradable material) placed in the hollow part so as to control the flow of the fluid. In addition, a member such as an anti-rotation feature, for example, for linking or releasing the plug for well drilling process and/or the members thereof to and from one another or other members may be provided. The plug for well drilling process of the present invention may also be entirely formed from a degradable material.

[Well Hole Isolation]

The plug for well drilling process of the present invention applies transmits a force in the axial direction of the mandrel 1 to the diameter-expandable circular rubber member 3 by applying a force in the axial direction of the mandrel 1 to the pair of rings 2 and 2'. As a result, the diameter-expandable circular rubber member 3 expands in the direction orthogonal to the axial direction of the mandrel 1 as it is compressed in the axial direction of the mandrel 1 so as to make contact with the inside wall H of the well hole as it is compressed in the axial direction of the mandrel 1, which makes it possible to isolate (seal) the space between the plug and the well hole (well hole isolation). Next, fracturing can be performed in a state in which the space between the plug and the well hole is isolated (sealed). After fracturing is complete, the diameter-expandable circular rubber member 3 is left behind in the well hole in the expanded state and collaborates with the combination of slips 4 and 4' and wedges 5 and 5' provided as desired so as to be able to fix the plug for well drilling process to a prescribed position of the well hole. In addition, when performing isolating (sealing) or the like in a downhole in a high-temperature environment in which the members of the plug for well drilling process are degraded in a short period of time, a treatment method of infusing a fluid from above ground and controlling the ambient temperature of the plug for well drilling process to a reduced state so as to maintain the seal performance (strength or the like) for a desired amount of time.

[Degradation of Plug for Well Drilling Process]

After the fracturing of each prescribed section is complete—ordinarily when starting the production of petroleum, natural gas, or the like after well drilling is finished and the well is complete—at least the mandrel 1 of (a) and the pair of rings 2 and 2' of (b) and, as desired, the diameter-expandable circular rubber member 3 of (c) of the plug for well drilling process of the present invention can be easily degraded and removed by biodegradation, hydrolysis, or chemical degradation by means of another method. As a result, with the plug for well drilling process of the present invention, the substantial cost and time conventionally required to remove, recover, or destroy or fragmentize, by pulverization, perforation, or another method, many plug for well drilling process remaining inside a well after the completion of the well become unnecessary, which makes it possible to reduce the cost or steps of well drilling. In addition, the members of the plug for well drilling process remaining after well treatment are preferably completely eliminated by the time production is begun. However, even if they are not completely eliminated, as long as they are in a state in which they can be collapsed by stimulation such as water flow in the downhole as the strength decreases, the collapsed members of the plug for well drilling process can be easily recovered by means of flowback or the like. Therefore, there is no risk of causing clogging in the downhole or fractures, so the production of petroleum, natural gas, or the like is not inhibited. Further, the degradation or reduction in strength of the members of the plug for well drilling process ordinarily progresses in a shorter amount of time when the temperature of the downhole is higher. In addition, the water content in the stratum may be low depending on the well, and in this case, the degradation of the plug for well drilling process can be accelerated by leaving the water-based fluid used at the time of fracturing behind in the well without recovering the fluid after fracturing.

II. Plug for Well Drilling Process Production Method

The production method of the plug for well drilling process of the present invention is not particularly limited as long as it is possible to produce a plug for well drilling process comprising (a) a mandrel, (b) a pair of rings, and (c) a diameter-expandable circular rubber member. For example, a plug for well drilling process can be obtained by molding each member provided in the plug for well drilling process by means of injection molding, extrusion molding (including solidification- and extrusion-molding), centrifugal molding, compression molding, or another known molding method, for example, machining the each obtained member by cutting, boring, or the like as necessary, and then combining the members themselves with a known method.

When the plug for well drilling process of the present invention is a plug for well drilling process in which the mandrel and one of the rings of the pair of rings are formed integrally, the mandrel and one of the rings of the pair of rings are preferably formed integrally by integral molding by means of a molding method such as injection molding, extrusion molding (including solidification- and extrusion-molding), or centrifugal molding or by machining such as cutting.

III. Well Drilling Method

With the well drilling method of degrading part or all of the plug for well drilling process after the well hole is plugged using the plug for well drilling process of the present invention, when starting the production of petroleum, natural gas, or the like after the fracturing of each prescribed section is complete or after well drilling is finished and the well is complete, at least the mandrel and the pair of rings, as desired, the diameter-expandable circular rubber member of the plug for well drilling process of the present invention can be easily degraded and removed by biodegradation, hydrolysis, or chemical degradation by means of another method. As a result, with the well drilling method of the present invention, the substantial cost and time conventionally required to remove, recover, or destroy or fragmentize, by pulverization, perforation, or another method, many plug for well drilling process remaining inside a well after the completion of the well become unnecessary, which makes it possible to reduce the cost or steps of well drilling.

INDUSTRIAL APPLICABILITY

The present invention provides a plug for well drilling process comprising: (a) a mandrel formed from a degradable material;

(b) a pair of rings placed on an outer peripheral surface existing in the orthogonal to an axial direction of the mandrel, at least one of the rings being formed from a degradable material; and (c) at least one diameter-expandable circular rubber member placed at a position between the pair of rings on the outer peripheral surface existing in the orthogonal to the axial direction of the mandrel.

As a result, the present invention enables the reliable isolating and fracturing of a well hole under increasingly rigorous mining conditions such as higher depths, and is capable of reducing the cost of well drilling and shortening the process by facilitating the removal of the plug for well drilling process and the procurement of a flow path, which yields high industrial applicability.

In addition, the present invention provides a well drilling method in which part or all of the plug for well drilling process is degraded after the well hole is plugged using the plug for well drilling process. As a result, it is possible to reliably isolate the well hole and to perform fracturing, which facilitates the removal of the plug for well drilling process or the procurement of a flow path. Accordingly, a well drilling method with which the cost of well drilling can be reduced and the process can be shortened is provided, which yields high industrial applicability.

REFERENCE SIGNS LIST

1: Mandrel
2, 2': Rings
3: Diameter-expandable circular rubber member
4, 4': Slips
5, 5': Wedges
H: Inside wall of well hole

The invention claimed is:

1. A plug for well drilling process provided with:

(a) a mandrel formed from a degradable material, the degradable material being a polyglycolic acid having a weight average molecular weight of 180,000 to 300,000 and having a melt viscosity of 700 to 2,000 Pa·s as measured at a temperature of 270° C. and a shear rate of 122 $sec^{-1}$;

(b) a pair of rings placed on an outer peripheral surface existing in the orthogonal to an axial direction of the mandrel, at least one of the rings being formed from a degradable material; and (c) at least one diameter-expandable circular rubber member placed at a position between the pair of rings on the outer peripheral surface existing in the orthogonal to the axial direction of the mandrel.

2. The plug for well drilling process according to claim 1, wherein the mandrel is formed from a degradable material having a tensile strength of at least 50 MPa at a temperature of 60° C.

3. The plug for well drilling process according to claim 1, wherein the mandrel is formed from a degradable material having a shearing stress of at least 30 MPa at a temperature of 66° C.

4. The plug for well drilling process according to claim 1, wherein the mandrel has a tensile load capacity of at least 5 kN at a temperature of 66° C.

5. The plug for well drilling process according to claim 1, wherein the mandrel is formed from an aliphatic polyester containing a reinforcing material.

6. The plug for well drilling process according to claim 1, wherein the mandrel has a thickness reduction of less than 5 mm after immersion for one hour in water at a temperature of 66° C. and has a thickness reduction of at least 10 mm after immersion for 24 hours in water at a temperature of at least 149° C.

7. The plug for well drilling process according to claim 1, wherein the mandrel has a hollow part along the axial direction.

8. The plug for well drilling process according to claim 1, wherein the mandrel has a locking mechanism for fixing the diameter-expandable circular rubber member to the outer peripheral surface in a compressed state.

9. The plug for well drilling process according to claim 8, wherein the locking mechanism is at least one type selected from the group consisting of a groove, a stepped part, and a screw thread.

10. The plug for well drilling process according to claim 1, wherein a radius of curvature of a processed portion of the outer peripheral surface of the mandrel is at least 0.5 mm.

11. The plug for well drilling process according to claim 1, wherein the mandrel and one of the pair of rings are formed integrally.

12. The plug for well drilling process according to claim 1, wherein pair of rings are formed from a degradable material having a shearing stress of at least 30 MPa at a temperature of 66° C.

13. The plug for well drilling process according to claim 1, wherein the plug comprises a plurality of diameter-expandable circular rubber members as said at least one diameter-expandable circular rubber member.

14. The plug for well drilling process according to claim 1, wherein the diameter-expandable circular rubber member is formed from a degradable material.

15. The plug for well drilling process according to claim 1, wherein the plug comprises at least one combination of a slip and a wedge placed at a position between the pair of rings on the outer peripheral surface existing in the orthogonal to the axial direction of the mandrel.

16. The plug for well drilling process according to claim 15, wherein the slip and/or wedge are formed from a degradable material.

17. The plug for well drilling process according to claim 15, wherein the slip and/or wedge are formed from a material containing at least one of a metal or an inorganic substance.

18. The plug for well drilling process according to claim 15, wherein the slip and/or wedge are formed from a degradable material and a material containing at least one of a metal or an inorganic substance.

19. The plug for well drilling process according to claim 15, wherein the plug comprises a plurality of combinations of slips and wedges.

20. The plug for well drilling process according to claim 1, wherein a reduction rate in a mass of the degradable material after immersion for 72 hours in water at a temperature of 150° C. with respect to a mass prior to immersion is from 5 to 100%.

21. The plug for well drilling process according to claim 1, wherein the degradable material contains a reinforcing material.

22. The plug for well drilling process according to claim 1, wherein the degradable material is an aliphatic polyester.

23. The plug for well drilling process according to claim 22, wherein the aliphatic polyester is a polyglycolic acid.

24. The plug for well drilling process according to claim 23, wherein the polyglycolic acid has a weight average molecular weight of 180,000 to 300,000 and a melt viscosity of 700 to 2,000 Pa·s when measured at a temperature of 270° C. and a shear rate of 122 $sec^{-1}$.

25. A well drilling method in which part or all of the plug for well drilling process according to claim 1 degrades after a well hole is plugged using the plug for well drilling process.

26. A plug for well drilling process comprising: ($a_1$) a mandrel formed from a degradable material having a tensile strength of at least 50 MPa at a temperature of 60° C., the degradable material being a polyglycolic acid having a weight average molecular weight of 180,000 to 300,000 and having a melt viscosity of 700 to 2,000 Pa·s as measured at a temperature of 270° C. and a shear rate of 122 $sec^{-1}$, the mandrel having a thickness reduction of less than 5 mm after immersion for one hour in water at a temperature of 66° C. and having a thickness reduction of at least 10 mm after immersion for 24 hours in water at a temperature of at least 149° C.;

(b) a pair of rings placed on an outer peripheral surface existing in the orthogonal to an axial direction of the mandrel, at least one of the rings being formed from a degradable material; and (c) at least one diameter-expandable circular rubber member placed at a position between the pair of rings on the outer peripheral surface existing in the orthogonal to the axial direction of the mandrel.

27. A well drilling method in which part or all of the plug for well drilling process according to claim 26 degrades after a well hole is plugged using the plug for well drilling process.

28. A plug for well drilling process comprising: ($a_2$) a mandrel formed from a degradable material having a tensile strength of at least 50 MPa at a temperature of 60° C., the degradable material being a polyglycolic acid having a weight average molecular weight of 180,000 to 300,000 and having a melt viscosity of 700 to 2,000 Pa·s as measured at a temperature of 270° C. and a shear rate of 122 $sec^{-1}$;

(b) a pair of rings placed on an outer peripheral surface existing in the orthogonal to an axial direction of the mandrel, at least one of the rings being formed from a degradable material; and (c) at least one diameter-expandable circular rubber member placed at a position between the pair of rings on the outer peripheral surface existing in the orthogonal to the axial direction of the mandrel, a percentage of mass loss in the degradable material after immersion for 72 hours in water at a temperature of 150° C. with respect to a mass prior to immersion being from 5 to 100%.

29. A well drilling method in which part or all of the plug for well drilling process according to claim 28 degrades after a well hole is plugged using the plug for well drilling process.

30. A plug for well drilling process comprising: ($a_3$) a mandrel formed from a degradable material having a shearing stress of at least 30 MPa at a temperature of 66° C., the degradable material being a polyglycolic acid having a weight average molecular weight of 180,000 to 300,000 and having a melt viscosity of 700 to 2,000 Pa·s as measured at a temperature of 270° C. and a shear rate of 122 $sec^{-1}$;

(b) a pair of rings placed on an outer peripheral surface existing in the orthogonal to an axial direction of the mandrel, at least one of the rings being formed from a degradable material; and (c) at least one diameter-expandable circular rubber member placed at a position between the pair of rings on the outer peripheral surface existing in the orthogonal to the axial direction of the mandrel, a percentage of mass loss in the degradable material after immersion for 72 hours in water at a temperature of 150° C. with respect to a mass prior to immersion being from 5 to 100%.

31. A well drilling method in which part or all of the plug for well drilling process according to claim 30 degrades after a well hole is plugged using the plug for well drilling process.

* * * * *